United States Patent [19]

Rehm

[11] 4,058,087

[45] Nov. 15, 1977

[54] BOILER

[75] Inventor: Gustav A. Rehm, Milwaukee, Wis.

[73] Assignee: Aqua-Chem, Inc., Milwaukee, Wis.

[21] Appl. No.: 679,660

[22] Filed: Apr. 23, 1976

[51] Int. Cl.[2] ..... F22B 21/14; F23B 1/22; F23C 1/02; F23C 1/04

[52] U.S. Cl. ..... 122/235 R; 110/22 R; 110/40 R; 122/347; 110/28 L

[58] Field of Search ..... 122/235 R, 347; 110/22 R, 22 A, 28 L, 40

[56] References Cited

U.S. PATENT DOCUMENTS

| | | | |
|---|---|---|---|
| 2,110,452 | 3/1938 | Moyer | 110/40 |
| 2,221,382 | 11/1940 | Kuhner | 122/347 |
| 2,263,433 | 11/1941 | Allen | 110/28 |
| 2,554,384 | 5/1951 | Rehm | 110/22 |
| 2,693,173 | 11/1954 | Marquez, Jr. | 110/40 |
| 2,730,997 | 1/1956 | Birkner | 110/40 |
| 3,188,987 | 6/1965 | Anschutz | 110/22 |
| 3,395,657 | 8/1968 | Schuss | 110/22 |

*Primary Examiner*—Kenneth W. Sprague
*Attorney, Agent, or Firm*—Fred Wiviott

[57] ABSTRACT

A boiler including a combustion chamber having an open upper end and a boiler section having an inlet above the furnace and extending generally horizontally therefrom. The combustion chamber includes a blower, a nozzle or burner for gas or liquid fuels and a coal combustion system. Water tubes lining the combustion chamber are interconnected with water tubes in the boiler section.

5 Claims, 3 Drawing Figures

BOILER

BACKGROUND OF THE INVENTION

This invention relates to boilers, more particularly boilers adapted for burning alternate fuels.

Because the availability and cost of certain fossil fuels such as oil and gas fluctuate, it often becomes desirable to employ alternate fuels, such as coal, at least temporarily until the shortages may be abated. In certain applications, such as boilers, this is not always feasible because boiler systems designed solely for the burning of oil or gas cannot be readily converted for coal burning.

SUMMARY OF THE INVENTION

It is an object of the invention to provide a new and improved boiler.

A further object of the invention is to provide a boiler in which oil, gas, coal or waste products may be employed as fuel, either singly or in combination.

Another object of the invention is to provide a boiler having coal, oil and/or gas combustion systems and in which heating is achieved in all portions of the heat exchange system.

A still further object of the invention is to provide a boiler system capable of burning alternate types of fuel wherein all fuel ignition and combustion is achieved in a single combustion area.

Yet another object of the invention is to provide a multiple fuel combustion system for boilers wherein the production of nitrogen and sulfurous oxides are minimized.

A further object of the invention is to provide a boiler capable of utilizing alternate fuel types wherein heat is provided to all furnace tubes at their lowest elevation to insure complete water circulation at all loads and with any fuel, burned singly or in combination.

These and other objects and advantages of the present invention will become more apparent from the detailed description thereof taken with the accompanying drawings.

In general terms, the invention comprises a boiler including first means defining a primary combustion zone, second means defining a combustion gas receiving zone disposed above said primary combustion zone, passage defining means for connecting said primary combustion zone and said combustion gas receiving zone, first combustion means for delivering a first fuel and combustion air to said primary combustion zone and coal burning means disposed at the lower end of the primary combustion zone. The second means also defines a tube space adjacent the hot combustion gas receiving zone. A first water tube means is disposed in the tube receiving space, a second water tube means is disposed in the primary combustion zone, and tube means interconnect the first and second water tube means so that circulation therebetween will occur when the burner means or the coal burning means or both are operated.

DETAILED DESCRIPTION OF THE INVENTION

Figure 1:
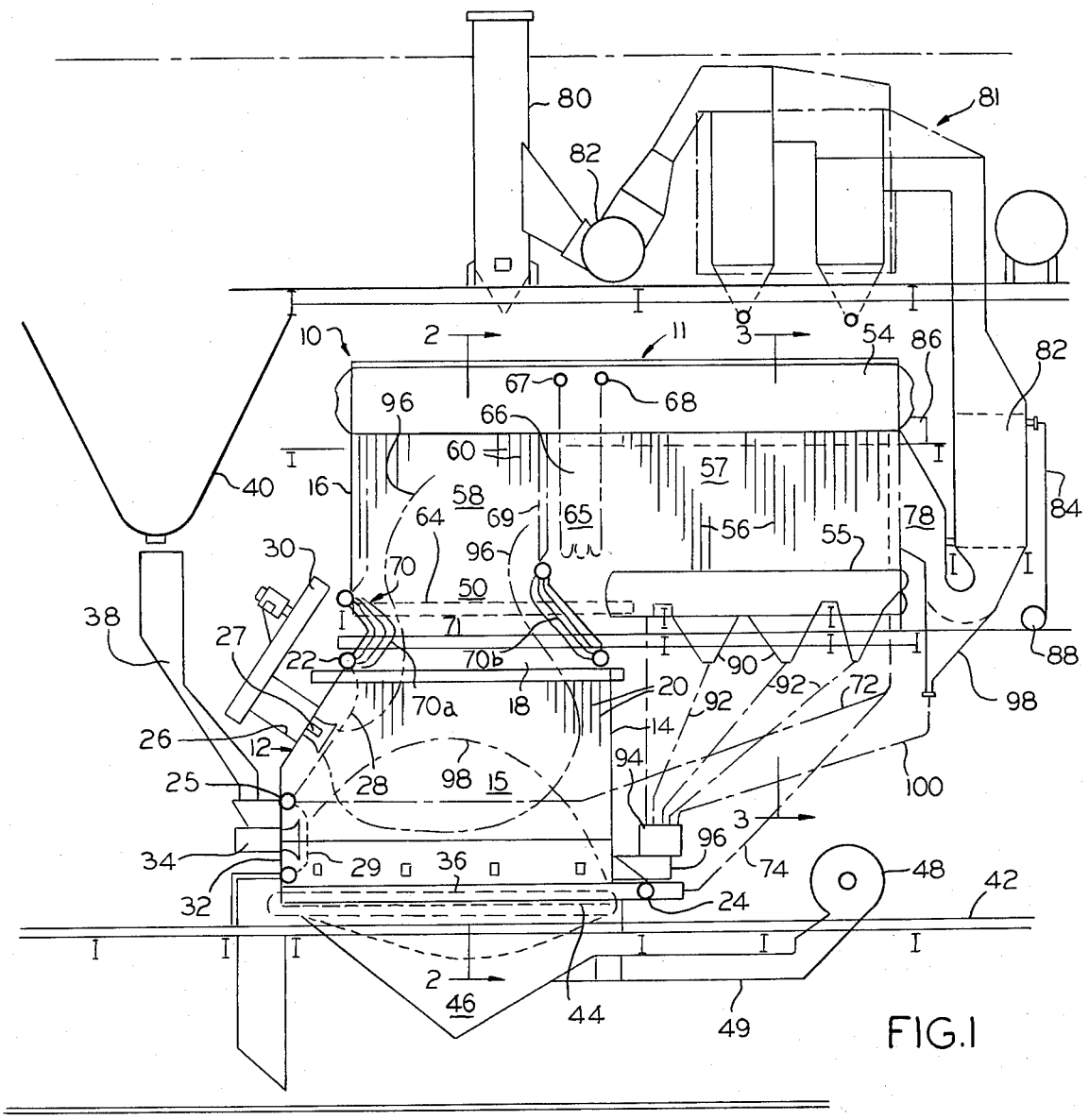
FIG. 1 is a side elevational view schematically illustrating the boiler according to the present invention.
Figure 2:
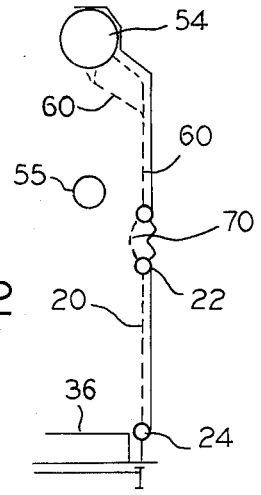
FIG. 2 is a view taken along lines 2—2 of FIG. 1.
Figure 3:
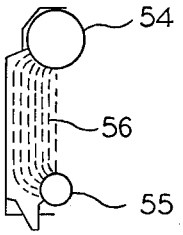
FIG. 3 is a view taken along lines 3—3 of FIG. 1.

The boiler 10 according to the present invention is shown in FIG. 1 to include a boiler section 11 and a furnace section 12. Furnace 11 includes a housing 14 defining a combustion chamber 15 which may be formed of any suitable materials such as an outer metallic shell and a suitable heat insulating refractory lining. The furnace housing 14 is hollow and has an opening 18 at its upper end. The inner surface of furnace housing 14 is lined with water wall tubes 20 extending between an upper manifold pipe 22 which surrounds the opening 18 and a lower manifold pipe 24 which surrounds the lower end of furnace section 12. In addition, an intermediate manifold pipe 25 extends along the lower edge of an inclined upper portion 26 of the front furnace wall of furnace section 11. A suitable burner 27 for oil, gas or waste fuel extends through the inclined front wall portion 26. Water wall tubes 28 and 29 extend between manifold 25 and manifolds 22 and 24, respectively. A blower 30 is mounted adjacent the inclined front wall portion 26 for delivering combustion air to the combustion chamber 15 in association with burner 27. The burner 27 and the blower 30 may be of any conventional type and their specific structure or method of operation forms no part of the present invention. Accordingly, the details of burner 28 and blower 30 will not be described in detail for the sake of brevity. It will be sufficient for purposes of the invention to appreciate that the burner may be constructed and arranged for burning oil, waste fuel and/or gaseous fuels. In the case of oil, the burner typically would include a nozzle for atomizing fuel and mixing the same with at least a portion of the combustion air. In addition, the blower would deliver the air required for combustion either directly through the nozzle, through the furnace wall areas adjacent the nozzle or a portion may be delivered through each. Also, if secondary combustion was desired, a portion of the air may be delivered at locations downstream of the nozzle. Typically, also, a gas burner would include means for suitably mixing combustion air with the gaseous fuel. If a combined gas/oil is employed, the gas jets may be located adjacent the oil nozzle.

Located below the inclined wall portion 27 at the front of the furnace 12 is a generally vertical wall 32. A coal feeder 34 is mounted adjacent front wall portion 32 and is discharged and opens into combustion chamber 15 for delivering solid waste fuel or crushed coal to a spreader-stoker or chain grate 36 mounted at the lower end of chamber 15. The inlet end of feeder 34 is coupled by a feed hopper 38 to a "bunker" or silo 40. Furnace section 12 is suitably supported above the stoker floor 42 to permit the spreader-stoker or chain grade 36 to circulate in a continuous path from the front of furnace section 12 into the rear thereof. In this manner, coal is carried across the combustion chamber 15. The bottom wall 44 of the furnace section 12 is perforated and connects the furnace chamber 15 to a plenum chamber 46 formed therebelow. A blower 48 is connected by conduit 49 to plenum chamber 46 for delivering combustion air through the openings in bottom wall 44 and to the combustion chamber 15 when coal is being burned. In addition, a suitable ash removal system which is not shown, but is well known in the art, is disposed below plenum chamber 46. The coal feeder 34, the spreader-stoker or chain grade 36, the feed hopper 38, the coal bunker 40 and the blower 48 may be of any conventional type and accordingly, will not be described in detail for the sake of brevity.

The boiler section 11 is generally elongate with one end thereof disposed generally above the combustion chamber 15 and has an opening 50 formed in its lower end and generally in registry with the opening 18 in the upper end of combustion chamber 15. The opening 50 is spaced vertically above the opening 18 and this gap is occupied by a throat section 52 which connects the two openings and couples the furnace chamber 15 to the interior of the boiler section 11.

Boiler section 11 also includes an upper hot water and steam drum 54 and a lower drum 55. A plurality of water tubes 56 extend between the upper drum 54 and the lower drum 55 to define a flow path for hot combustion gases. Also disposed in the tube space 57 may be a plurality of baffles (not shown) which define a tortuous flow path for hot combustion gases to increase heat transfer.

The portion of the boiler section 11 disposed above the opening 50 defines a combustion space 58 which is lined by furnace cross over tubes 60 extending from drum 54 back across the center line of space 62 and downwardly along the sides of space 58 to a manifold 64 which surrounds opening 50. Between the combustion space 58 and the tube space 57 is a superheater space 65 in which superheater tubes 66 are disposed and which are coupled to manifold pipes 67 and 68. Screen tubes 69 are connected to drum 54 and extend downwardly therefrom to manifold 50 and between the combustion space 58 and superheater space 65.

A group of tubes 70 couple the manifold 64 which surrounds opening 50 and the manifold 22 which surrounds opening 18. The tubes 70 thereby define a passage or throat 71 between the combustion spaces 15 and 58. As seen in FIG. 1, the opening 18 in furnace section 12 is larger than and offset relative to the opening 50 in boiler section 11. Also, the tubes **70*a* at the front side of passage 71 are angular and have their knee pointed inwardly while the tubes 70*b* are inclined generally upwardly and toward the front of passage 71. The passage 71 thus defined by tubes 70 is inclined generally from the rear portion of furnace section 12 toward the opening 50. This causes hot gases and combustion products to flow toward the front of furnace section 12 and then reverse direction to flow upwardly through passage 71. The nonlinear configuration of tubes 70 also facilitate thermal expansion and contraction thereby providing a flexible belt between the combustion chambers 15 and 58. Interconnection between the manifolds 24 and 25 and the drum 55 is provided by downcomer tubes 71 and 74**.

The flue outlet 78 of the boiler section 11 may be connected to a discharge stack 80 through any suitable gas cleaning system 81. An economizer 82 may also be disposed in the flue outlet for preheating the boiler feedwater and toward this end is coupled by pipes 84 and 86 between the feedwater pump 88 and drum 54.

Lower end of boiler section 11 is provided with a plurality of generally conical soot collectors 90 for collecting unburned particulates when coal is being burned. Collectors 90 are coupled by conduits 92 to a reinjection collector pot 94. A conventional reinjector 96 is connected to the lower end of pot 94 and reinjects collected soot into the combustion chamber 15 and above the spreader-stoker chain grade 36. A soot collector 98 is also disposed in flue outlet 78 and below economizer 82 and is connected by conduit 100 to the collector pot 94.

When fuel oil or gas is burned in combustion chamber 15, the flame will be shaped generally as indicated by lines 96. Specifically, the initial portion of the flame will extend downwardly and inwardly of the combustion chamber 15 and then curve backwardly and upwardly through passage 71 and into combustion space 58, past the screen tubes 69, the superheater tubes 66 and into the tube space 57. The hot gases will be directed through the staggered baffles (not shown) in tube space 57 to increase heat transfer. The flue gases will pass outwardly through flue 78 past the economizer 82 and into the gas cleaning system for exhaustion through stack 80 under the influence of the exhaust fan 82.

In the case where coal is burned in furnace 12, the flame will generally take the shape indicated by line 98 in FIG. 1 or more specifically, be somewhat parabolic. The hot gases generated by the flame 98 initially flow toward the front of the furnace section 12 and then back toward the front and upwardly through passage 71 and into boiler section 11 in the same manner as discussed with respect to fuel oil or gas. It will be appreciated, too, that fuel oil, gas or waste fuel and/or coal may be burned simultaneously in furnace 15 is so desired. In any event, because coal and/or oil, gas and waste fuel are burned in the same combustion chamber 15, the furnace tubes 20 will be heated at their lowest point during the start of water circulation. As a result, circulation static heads for all furnace tubes will be the same for any specific heat load regardless of the fuel or combination of fuels burned. This minimizes the buildup of corrosive gases, segregation of solids or the collection of chemicals in specific tubes or groups of tubes so that circulation is unimpaired. In addition, because heat is radiated from tubes 71 and the combustion space 58 back into furnace chamber 15, low excess air complete combustion is possible to minimize the formation of nitrogen and sulfurous oxides. Also, faster burnout of coal results to provide more complete combustion of particulates. Also, the flow reversal of the oil and gas flame promotes temperature equalization of combustion gases.

The height of the collar 18 is governed by the type of coal to be burned. If high grade coal is employed, the collar can be relatively short, whereas if low grade fuel or garbage is burned in combustion chamber 15, a longer collar 18 is necessary to insure complete burnout. The boiler illustrated in the drawings is particularly adapted for packaged or factory assembled block units designed primarily for industrial use rather than relatively much larger field erected boilers.

While only a single embodiment of the invention has been illustrated and described, it is not intended to be limited thereby but only by the scope of the appended claims.

I claim:

1. A boiler including first means defining a primary combustion zone, second means defining a combustion gas receiving zone disposed above said primary combustion zone, passage defining means disposed between said first and second means for connecting said primary combustion zone and said combustion gas receiving zone, coal burning means disposed at the lower end of said primary combustion zone and including means for injecting coal into said primary combustion zone, spreader means for distributing said coal across the lower end of said zone, and air delivery means for delivering combustion air upwardly into said primary combustion zone and through said spreader means, combustion means disposed adjacent the upper end of said primary combustion zone for delivering combustion air and a fluid fuel to said primary combustion zone, said combustion means being located below the passage defining means and is constructed and arranged for projecting fluid fuel and combustion air downwardly and inwardly into said primary combustion zone and in a direction which intersects said spreader means for producing a flame which extends into said zone and backwardly up through passage defining means into said combustion gas receiving zone whereby heat will be generated in said primary zone when either or both of said coal burning means or combustion means are operated, first water tube means disposed in said combustion gas receiving zone, second water tube means disposed in said primary combustion zone and disposed to be heated directly by said coal burning means or said combustion means, and third water tube means distinct from and interconnecting said first and second water tube means so that circulation therebetween will occur when said combustion means or said coal burning means are operated.

2. The boiler set forth in claim 1 wherein said third water tube means are disposed within said passage defining means and include a plurality of non-linear tubes extending generally in the direction of the flow of combustion products through said passage defining means, said tubes defining a flexible connection between said first and second means to permit relative expansion therebetween.

3. The boiler set forth in claim 2 and including first drum means disposed adjacent the upper end of said second means, and second drum means disposed adjacent the lower end of said second means, said first water tube means interconnecting said first and second drum means, said second and third water tube means being connected to one of said drum means.

4. The boiler set forth in claim 3 and including fourth tube means disposed in said second means and arranged in substantially surrounding relation to said combustion gas receiving zone, said fourth tube means being connected to one of said first and second drum means.

5. The invention set forth in claim 4 and including soot collecting means coupled to the lower end of said second means, and injecting means connected to said soot collecting means and coupled to said primary combustion zone for reinjecting collected soot therein.

* * * * *